US006547232B2

(12) United States Patent
Herda et al.

(10) Patent No.: US 6,547,232 B2
(45) Date of Patent: Apr. 15, 2003

(54) DEVICE AND METHOD FOR SWITCHING BETWEEN COLLECT AND STRAIGHT MODES ON A FOLDER

(75) Inventors: Philippe Francois Herda, Dover, NH (US); Christian Heinz Miescher, Newburgport, MA (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 220 days.

(21) Appl. No.: 09/728,323

(22) Filed: Dec. 1, 2000

(65) Prior Publication Data

US 2002/0066381 A1 Jun. 6, 2002

(51) Int. Cl.[7] ..... B41F 13/24
(52) U.S. Cl. ..... 270/232; 493/424
(58) Field of Search ..... 101/219, 232, 101/411; 493/424, 425, 426, 427, 428, 429, 431, 432, 434, 471, 475; 270/32, 37, 42, 45, 47–48, 50, 52.26, 60, 20.1

(56) References Cited

U.S. PATENT DOCUMENTS

| | | | | | |
|---|---|---|---|---|---|
| 3,038,719 | A | * | 6/1962 | Tyma, Jr. | 270/50 |
| 3,865,361 | A | * | 2/1975 | Neal | 101/411 |
| 5,000,433 | A | * | 3/1991 | Prum et al. | 270/49 |
| 5,088,708 | A | * | 2/1992 | Nowak | 270/47 |
| 5,287,805 | A | * | 2/1994 | Fischer et al. | 101/219 |
| 5,305,993 | A | * | 4/1994 | Staeb et al. | 270/37 |
| 5,772,571 | A | * | 6/1998 | Marcle-Geller et al. | 493/426 |
| 5,797,319 | A | | 8/1998 | Tomczak | 101/216 |
| 5,846,177 | A | * | 12/1998 | Mayr | 493/424 |
| 6,093,139 | A | | 7/2000 | Belanger | 493/353 |
| 6,250,622 | B1 | * | 6/2001 | Fowler et al. | 270/20.1 |
| 6,331,154 | B1 | * | 12/2001 | Shibuya et al. | 493/424 |

OTHER PUBLICATIONS

Braasch, William, *Newspaper Presses*, (1958), pp. 136–154, Ch. 6.

* cited by examiner

*Primary Examiner*—Eugene H. Eickholt
(74) *Attorney, Agent, or Firm*—Davidson, Davidson & Kappel, LLC

(57) ABSTRACT

A folder includes a cam having a cam follower path and a movable segment, the movable segment having a first actuating part and a second part, the first actuating part and the second part being selectively movable into the cam follower path. At holds an edge of a signature, the holding device being actuated by the at least one cam follower. Also disclosed is a method for switching a folder from a straight mode to a collect mode, the folder being actuated by a cam. The method includes moving a movable segment of the cam so that a raised section of the movable segment is in a cam follower path of the cam, so as to permit a straight mode of the folder, and moving the movable segment of the cam so that a non-raised section of the movable segment is in the cam follower path of the cam, so as to permit a collect mode of the folder.

16 Claims, 5 Drawing Sheets

DEVICE AND METHOD FOR SWITCHING BETWEEN COLLECT AND STRAIGHT MODES ON A FOLDER

BACKGROUND OF THE INVENTION

1. Field of the Invention

The present invention relates generally to printing presses and more particularly to a folder of a printing press.

2. Background Information

Web printing presses print a continuous web of material, such as paper. In a folder of the printing press, the continuous web then is cut into signatures in a cutting unit and folded.

One way to fold the resulting signatures is using a rotary blade folder, which includes a folding cylinder with tucker blades which provide a fold to the signature. The fold is forced by the tucker blade toward two rotating fold rolls, which grip the signature along the fold at a nip, set the fold and deliver the folded product, for example, to a fan unit.

Chapter 6 (pages 136 to 154) of the book "Newspaper Presses" by William Braasch describes the two basic kinds of rotary blade folders: 2 to 1 folders and 3 to 2 folders. In a 2 to 1 rotary blade folder, two sets of tucker blades are spaced 180 degrees apart on the folding cylinder. A signature is held by pins spaced 90 degrees ahead of a tucker blade set and when the signature midpoint reaches the fold rollers, the tucker blade pushes the signature at the midpoint into the fold rollers so as to form the fold. Thus in a 2 to 1 folder, two sets of pins spaced 180 degrees apart are present, for holding edges of the products to be folded. In a 3 to 2 folder, three sets of pins spaced 120 degrees apart are present. Sets of tucker blades operate at a midpoint of a signature to produce a fold by pushing the midpoint into a pair of fold rollers.

In order to increase a page count of a product, folders in a printing press utilize a method of collecting sheets to form a larger product. To accomplish the collection of sheets, a tucker blade is silenced so that it does not perform a tucking operation into nip rollers and the pin holding the lead edge of the signature is not retracted. The silencing, which occurs in collect mode, permits the product to remain on a folding cylinder so that the folder is supplemented with additional sheets as a result of the folding cylinder rotating another revolution. When two sheets are collected by the cylinder, the two sheets may then be released by the pin and folded by the tucking blade. The collect mode is in contrast to the straight mode during which no folding blades are silent and no products are permitted to remain on the cylinder, so that each pin retracts every revolution. The switch from collect mode to straight mode or vice versa is called a changeover.

One way to move the pins on the rotary blade folder is with a rotating box cam. FIG. 1 shows the straight mode in a prior art three-to-two rotary blade folder 10 with a rotating box cam 20 for moving the pins. The cam makes a ½ rotation for every one third revolution of the pins and the cam followers. Pins 1, 2 and 3 are connected to and activated by cam followers 11, 12 and 13, respectively, and thus rotate together about the axis of the folder, although the cam followers 11, 12, 13 generally lag the pins 1, 2, 3 a few degrees due to the structure of the connection. The cam follower 11, 12, 13 and rotating cam 20 movement is displayed underneath the folder 10 for clarity. When a cam follower 11, 12 or 13 meets one of two raised sections 21 or 22 in the rotating box cam, the respective pin 1, 2 or 3 is retracted. Thus in section A of FIG. 1, pin 3 is retracted when cam follower 13 meets raised section 21. Signature 100 thus is released by pin 3, is tucked and folded by folding rolls 30. In section B, when raised section 22 (traveling faster than follower 12) and follower 12 meet, pin 2 is retracted as a next signature 101 is released, tucked and folded. In section C, pin 1 is retracted when follower 21 meets raised section 21. Next signature 102 is thus released by pin 1. In section D, pin 3 is again retracted, this time raised section 22 reaching follower 13. The cam followers may include two parallel rollers running in associated grooves slightly offset from one another.

To switch over to a collect mode, an operator disengages one of the tucking blades, stops the machine and physically removes one of the raised cam sections 21, 22 and replaces it with a non-raised section. Because the box cam and the cam follower are moving, it has generally not been possible to permit automatic switching between the collect and straight modes.

FIG. 2 shows a prior art collect mode with section 22 raised section removed and replaced by a non-raised section 23. In Section I of FIG. 2, pin 2 does not retract as a signature 104 passes by the folding rollers 30, because cam follower 12 is met by non-raised section 23 which does not actuate the pin 2. One of the tucking blades, which has be deactivated by another mechanism, also does not tuck. Thus signature 104 remains on the folder 10, as a signature 105 previously did. As shown in Section II, signature 105 thus is joined by a new second signature 106, as cam follower 11 reaches raised section 21. Pin 1 thus releases the lead edge of signatures 105 and 106. The two signatures 105, 106, properly collected, then are tucked by the activated tucking blade, and folded by folding rolls 30. As shown in Section III, signature 107 remains held by pin 3 on folder 30 since non-raised section 23 passes by cam follower 13. Signature 104 is joined by a new signature 108, which together then are folded when the signatures 104 and 108 are tucked. Pin 2 at the same time retracts as cam follower 12 and raised section 21 meet in Section IV. The collect action thus continues in this fashion.

The switch-over from a straight to a collect run using the box cam as shown in FIGS. 1 and 2 however is time-consuming and complicated. An operator manually switches the components, e.g. replaces raised section 22 with non-raised section 23. Moreover, if the parts do not fit properly or are misplaced, valuable time can be lost.

U.S. Pat. No. 5,797,319 purports to disclose a drive device for a folder in a printing press having a folding blade mounted to a folding blade shaft. A drive gear drives a folding blade shaft gear. The drive device also includes a plunger having an intermediate gear between the gear of the folding blade shaft and the drive gear, and a device for moving the plunger between a first longitudinal position and a second longitudinal position. In the first longitudinal position, the intermediate gear meshes with the folding blade shaft gear, whereas in the second longitudinal position, the intermediate gear is out of register with the drive gear. The drive device may also include a cam and an indexing ring operable in response to axial movement of the plunger. During the outward movement of the plunger caused by a helical spring, the cam race is contacted by the pin causing the cam index to rotate. Rotation of the cam permits further outward axial translation of the plunger, because the pin slidably engages different portions of the cam race as the pin continues to rotate. A first stop in the cam race corresponds to the plunger being in the first longitudinal position, and a second stop in the cam race corresponds to the plunger being in the second longitudinal position.

The device of the '319 patent does not address the problem of prevent pins from retracting during a changeover, but rather only seems to address the tucking motion. Moreover, the device requires a complex arrangement of parts.

Commonly-assigned U.S. Pat. No. 6,093,139 (which is not necessarily prior art to the present application) purports to disclose a product cutting device for flat material. A first and second cam follower assigned to a respective first and second cam move a lever and a further lever about a first and second pivot axis. By the first cam, a product seizing element is moved upon the surface of a cylinder in a direction opposite to the direction of rotation. A further lever assigned to the second cam opens and closes the product seizing element. The folder can, for example, be run in straight mode and/or collect mode. The arrangement of the '139 patent appears to require that the cam be altered to move between collect and straight modes.

BRIEF SUMMARY OF THE INVENTION

An object of the present invention is to provide a simplified device and method for switching a folder from straight to collect mode.

The present invention provides a folder including:

a cam having a cam follower path and a movable segment, the movable segment having a first actuating part and a second part, the first actuating part and the second part being selectively movable into the cam follower path;

at least one cam follower in the cam follower path; and at least holding device for holding an edge of a signature, the holding device being actuated by the at least one cam follower.

The folder advantageously permits for easy changes between a collect mode and a straight mode in a rotary blade folder.

The first actuating part preferably includes a raised section, and the second part preferably is a non-raised curved section having a radius of curvature similar to a main section of the cam follower path.

The cam preferably is a rotating box cam, and the first actuating part preferably includes a raised section and a corresponding cut-out section.

Preferably, the cam has a second raised section which is axially stationary in the cam follower path.

The movable segment advantageously may be slid axially along a cam bracket of the cam. Preferably, a pair of bearings pass through slits in the cam bracket to permit movement of the movable segment with respect to the cam bracket. The bearing may be moved by a cam segment housing which is activated by air cylinders.

The folder may further include at least one holding pin for locking the moveable segment in one of two positions. Preferably, the moveable segment has at least two holes for interacting with one of the at least one holding pins. An air cylinder may actuate and release the holding pin.

The folder preferably is a 3 to 2 rotary blade folder.

The present invention also provides a method for switching a folder from a straight mode to a collect mode, the folder being actuated by a cam, the method comprising the steps of:

moving a movable segment of the cam so that a raised section of the movable segment is in a cam follower path of the cam, so as to permit a straight mode of the folder; and moving the movable segment of the cam so that a non-raised section of the movable segment is in the cam follower path of the cam, so as to permit a collect mode of the folder.

The moving steps preferably are performed automatically using air cylinders.

The method preferably includes the step of locking the movable segment in one of the collect mode and the straight mode using a holding pin.

The moving steps preferably are accomplished by an axial sliding motion of the movable segment.

The present invention also provides a method for operating a rotary blade folder comprising the steps of:

moving a cam follower about a cam follower path of a cam;

releasing and holding leading edges of signatures on the rotary blade folder as a function of the cam follower moving on the cam follower path; and moving a movable segment of the cam through an actuating device so as to alter the cam follower path and switch the rotary blade folder from a straight mode to a collect mode.

Figure 3:
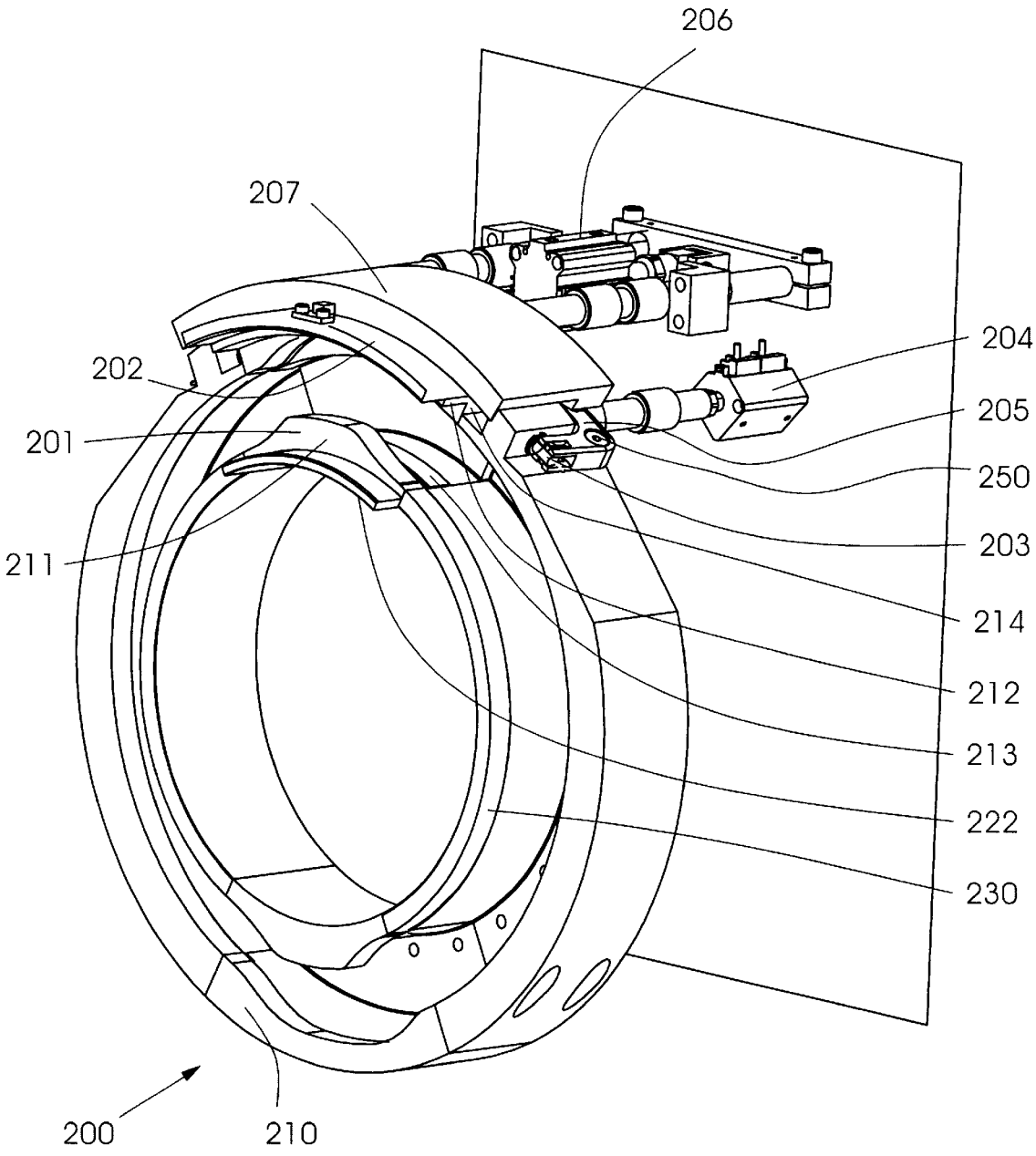
Figure 4:
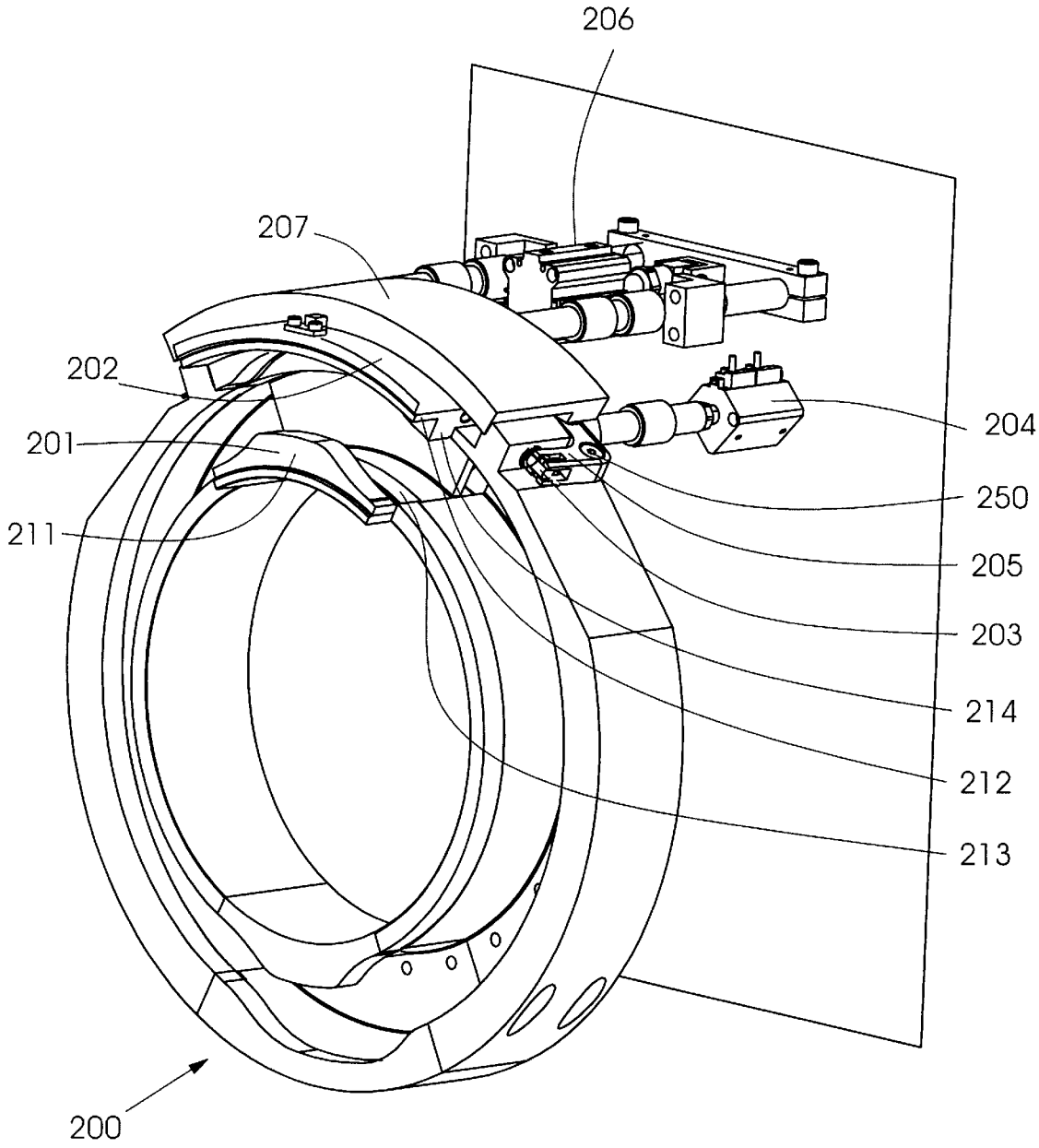
Figure 5:
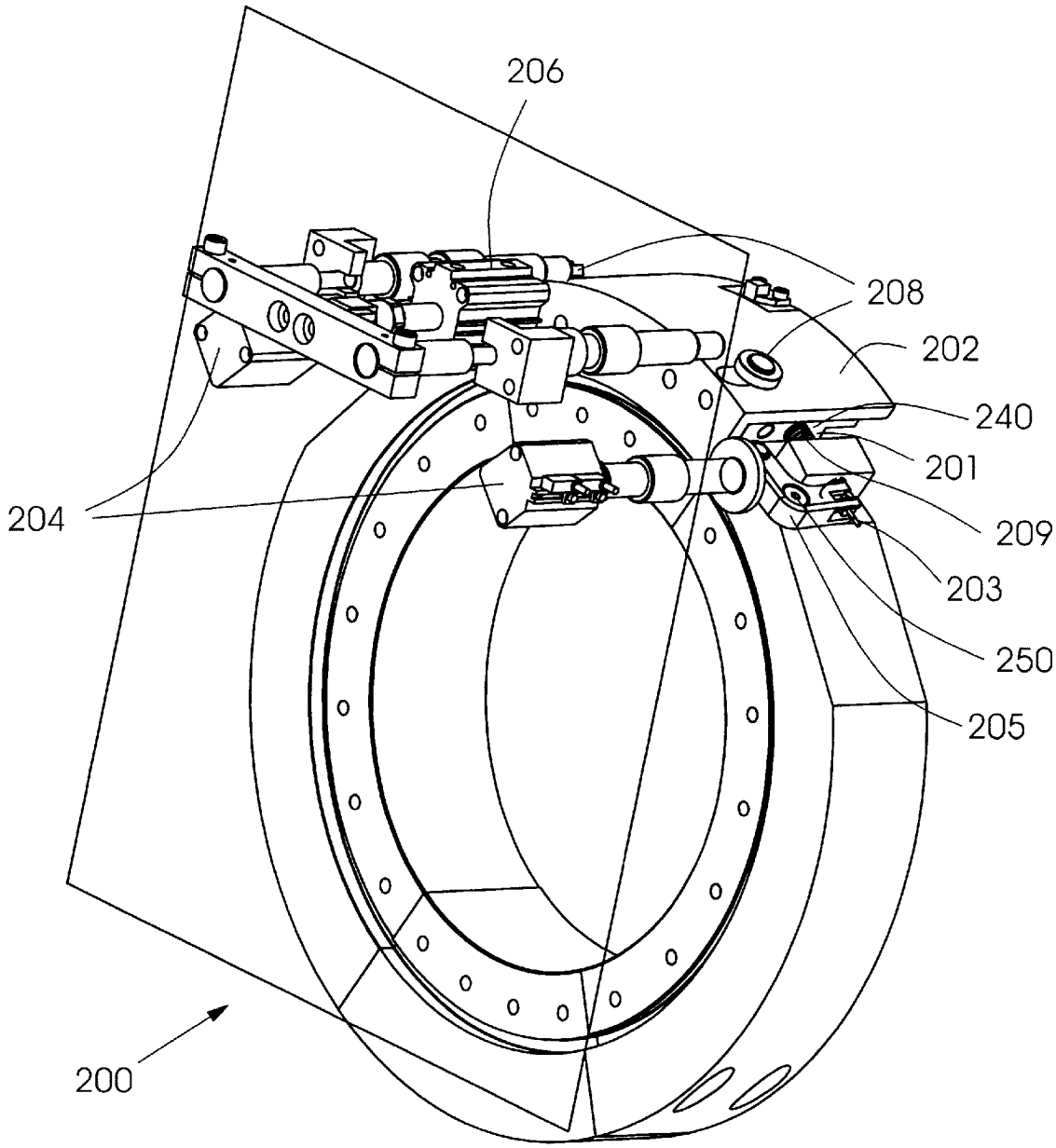

A preferred embodiment of the present invention is described below by reference to the following drawings, in which:

FIG. 3 shows a schematic front view of the box cam of the folder of the present invention in straight mode;

FIG. 4 shows a schematic front view of the box cam of FIG. 3 in collect mode; and FIG. 5 shows a schematic rear view of the box cam of FIG. 4.

DETAILED DESCRIPTION

Figure 1:
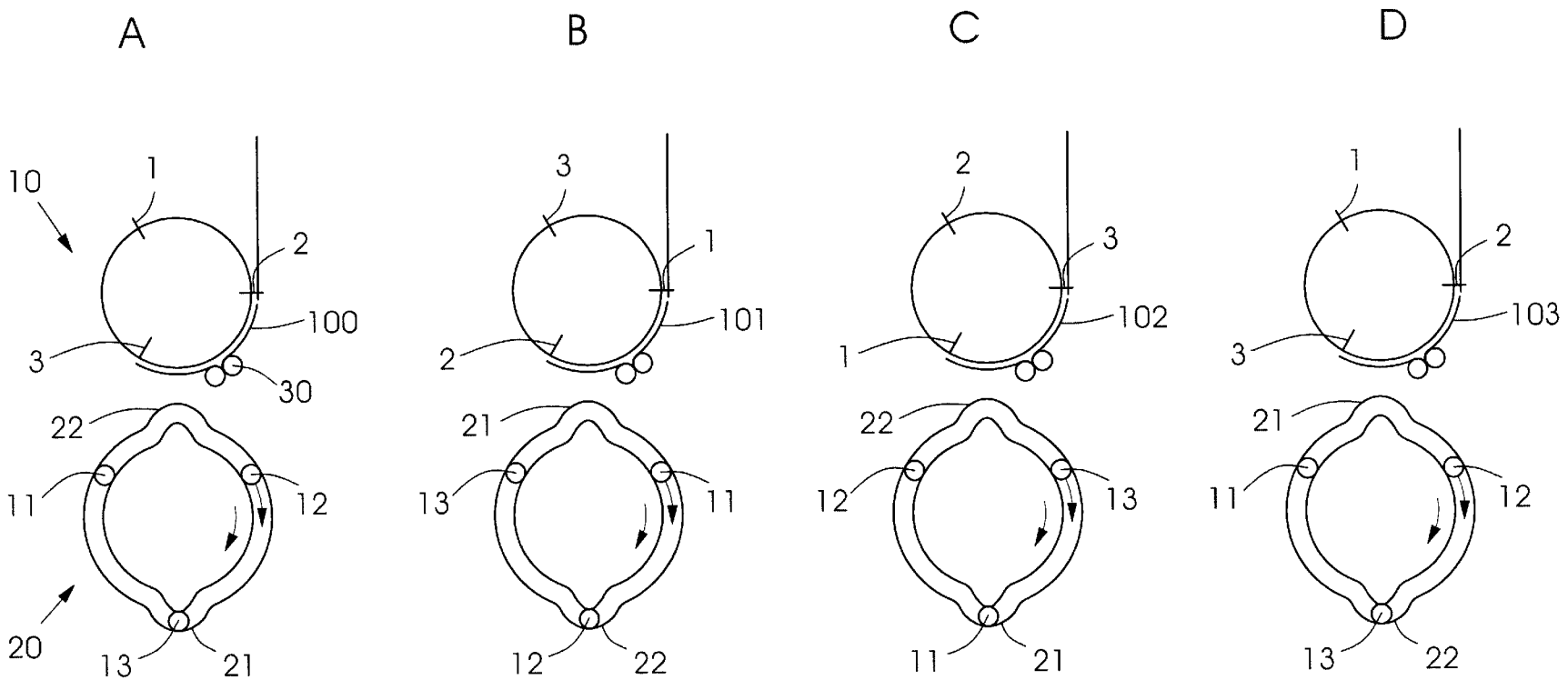
Fig.1 (Prior Art)
FIG. 1A–1D show schematic side views of a prior art 3–2 rotary blade folder during a straight run.
Figure 2:
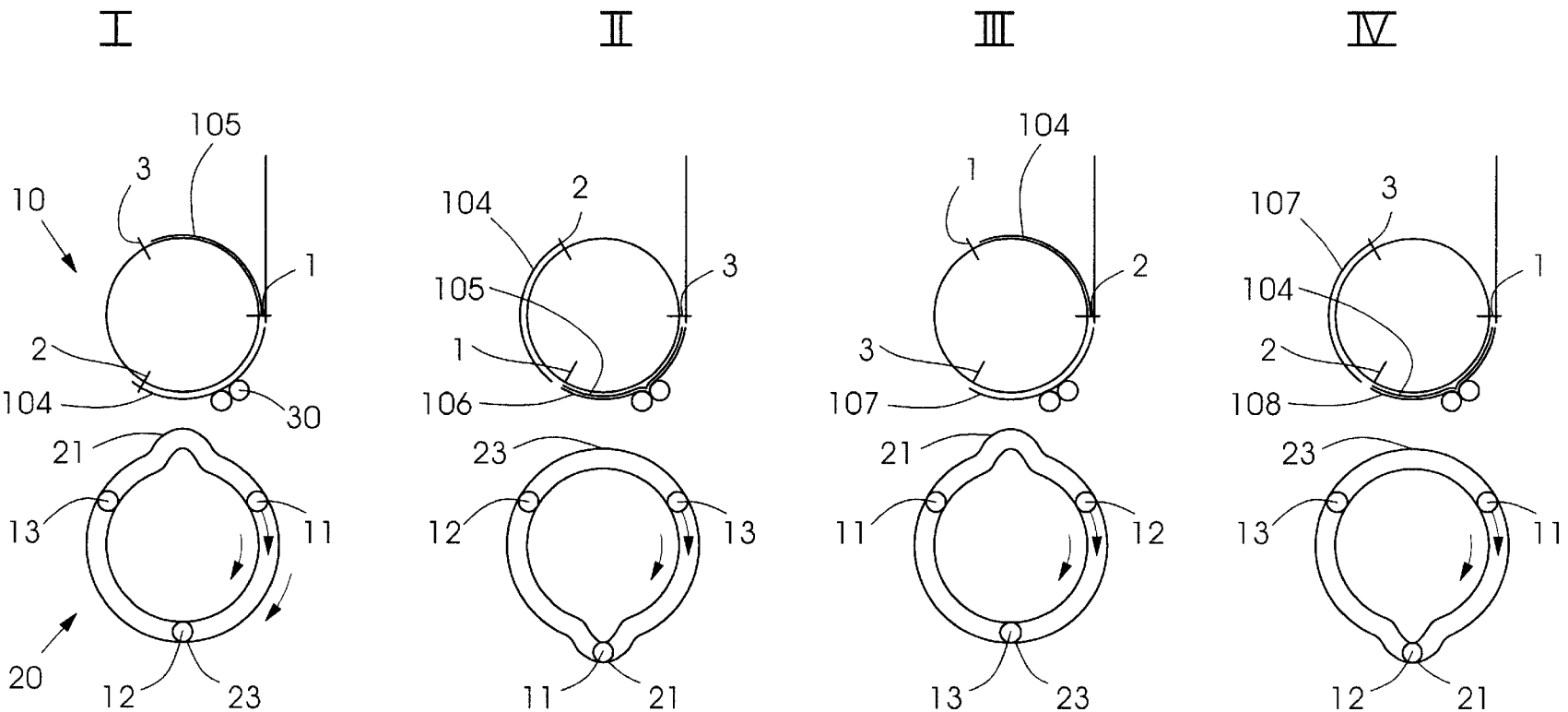
Fig.2 (Prior Art)
FIG. 2I–IV shows a schematic side-views of the prior art 3–2 rotary blade folder during a collect run.

FIG. 3 shows a schematic front view of a rotating box cam 200 of the present invention in straight mode. Box cam 200 can interact with a pin cylinder of a 3–2 rotary blade folder to control the pin motion as described with respect to the prior art embodiment of FIGS. 1 and 2. Box cam 200 has a first raised section 210 and a second movable cam segment 201, which can be moved axially between a straight mode position and a collect mode position. The cam segment 201 can move within a cam bracket 202, which has an upper section and a lower section 222. Cam segment 201 includes a raised section 211 and corresponding cut out section 212, which are shaped generally in the manner of section 210. A non-raised section with curved parts 213, 14 is located next to raised section 211 and section 212, respectively. The curved parts 213, 214 have a similar radius of curvature as curved section 230 of cam 200. Rotating curved section 230, section 210 and segment 201 form the rotating track of the box cam 200 for interaction with cam followers for activating the pins or other signature holding devices of the rotary blade folder.

The segment 201 can move between a straight mode as shown in FIG. 3 where the raised section 211 and the section 212 are in the path of the cam followers, and a collect mode as shown in FIG. 4, where the raised section 211 and section 212 are slid beyond the path of the cam followers, the cam followers then following a rotating path which includes curved parts 213 and 214, which are non-raised sections which do not activate the pins or other signature holding devices.

In order to switch the mode of operation from straight mode to collect mode, a pair of first air cylinders 204 actuate a pair of levers 205, which then unlocks a pair of holding pins 203 pivotable about a pair of pivots 250. The pair of holding pins 203, in turn, unlocks the cam segment 201. After the cam segment 201 has been unlocked, a second pair of air cylinders 206 pushes a cam segment housing 207 connected to cam segment 201. The cam segment housing 207 is connected to cam segment 201 through a pair of bearings 208 (see FIG. 5, which for clarity purposes is shown with housing 207 removed) that are clamped on the cam segment 201 and thus, pushes the cam segment 201 forward inside the cam bracket 202. When the cam segment 201 reaches the desired position, the first pair of air cylinders 204 cease actuating the pair of levers 205, and a pair of springs 209 (see FIG. 5) pushes the pair of holding pins 203 into the cam segment 201, thereby locking the cam segment 201 in the collect mode position.

FIG. 4 shows a schematic front view of the box cam 200 in collect mode. In order to switch the mode of operation from collect mode back to the straight mode, the pair of first air cylinders 204 again actuate the pair of levers 205, which then remove the pair of pins 203 via the pair of pivots 250 to unlock the cam segment 201. After the cam segment 201 has been unlocked, the second pair of air cylinders 206 pulls the cam segment housing 207. The cam segment housing 207 pulls the pair of bearings 208 (See FIG. 5) that are clamped on the cam segment 201 and thus, moves the cam segment 201 backward inside the cam bracket 202. When the cam segment 201 reaches the desired position, the first pair of air cylinders 204 cease actuating the pair of levers 205, and the pair of springs 209 (See FIG. 5) pushes the pair of pins 203 into the holes 240 in cam segment 201, thereby locking the cam segment 201 in the straight mode position.

FIG. 5 shows a schematic rear view of the box cam 200 as shown in FIG. 4 (collect mode) with the cam housing 207 removed. The pair of bearings 208 and the pair of springs 209 are visible.

The present invention permits for an automatic switch between straight and collect modes.

What is claimed is:

1. A folder comprising:

a cam having a cam follower path and a movable segment, the movable segment having a first actuating part and a second part, the first actuating part and the second part being selectively movable into the cam follower path;

at least one cam follower in the cam follower path; and at least holding device for holding an edge of a signature, the holding device being actuated by the at least one cam follower.

2. The folder as recited in claim 1 wherein the first actuating part includes a raised section and the second part is a non-raised curved section having a radius of curvature similar to a main section of the cam follower path.

3. The folder as recited in claim 1 wherein the cam is a rotating box cam.

4. The folder as recited in claim 3 wherein the first actuating part includes a raised section and a corresponding cut-out section.

5. The folder as recited in claim 1 wherein the cam has a second raised section stationary with respect to the cam follower path.

6. The folder as recited in claim 1 wherein the movable segment is slidable axially along a cam bracket of the cam.

7. The folder as recited in claim 6 further comprising a pair of bearings passing through slits in the cam bracket to permit movement of the movable segment with respect to the cam bracket.

8. The folder as recited in claim 1 further comprising at least one air cylinder for moving the movable segment.

9. The folder as recited in claim 1 further comprising at least one holding pin for locking the moveable segment in one of two positions.

10. The folder as recited in claim 9 wherein the moveable segment has at least two holes for interacting with one of the at least one holding pins.

11. The folder as recited in claim 10 further comprising an air cylinder for actuating the at least one holding pin.

12. The folder as recited in claim 1 wherein the folder is a 3 to 2 rotary blade folder.

13. A method for switching a folder from a straight mode to a collect mode, the folder being actuated by a cam, the method comprising the steps of:

moving a movable segment of the cam so that a raised section of the movable segment is in a cam follower path of the cam, so as to permit a straight mode of the folder; and moving the movable segment of the cam so that a non-raised section of the movable segment is in the cam follower path of the cam, so as to permit a collect mode of the folder.

14. The method as recited in claim 13 wherein the moving steps are performed using air cylinders.

15. The method as recited in claim 13 further comprising the step of locking the movable segment in one of the collect mode and the straight mode using a holding pin.

16. The method as recited in claim 13 wherein the moving steps are accomplished by an axial sliding motion of the movable segment.

* * * * *